US007722418B2

(12) United States Patent
Ellens et al.

(10) Patent No.: US 7,722,418 B2
(45) Date of Patent: May 25, 2010

(54) ENERGY DISSIPATION VALVES FOR HYDRAULIC CYLINDERS

(75) Inventors: Mark Ellens, Vancouver (CA); Edward Max Leite, Langley (CA); Graeme Michael Dempster, Richmond (CA); Jasenn Michael Howe, Vernon (CA)

(73) Assignee: Teleflex Canada Inc., Richmond (CA)

( * ) Notice: Subject to any disclaimer, the term of this patent is extended or adjusted under 35 U.S.C. 154(b) by 0 days.

(21) Appl. No.: 11/940,908

(22) Filed: Nov. 15, 2007

(65) Prior Publication Data

US 2008/0127816 A1 Jun. 5, 2008

Related U.S. Application Data

(63) Continuation of application No. 10/961,372, filed on Oct. 12, 2004, now abandoned.

(51) Int. Cl.
*B63H 5/125* (2006.01)
*B63H 20/08* (2006.01)

(52) U.S. Cl. ..... 440/56; 440/53

(58) Field of Classification Search ..... 417/437; 440/53, 56, 61 R; 188/310, 313, 316, 317, 188/322.5

See application file for complete search history.

(56) References Cited

U.S. PATENT DOCUMENTS

| | | | | | |
|---|---|---|---|---|---|
| 2,612,113 | A * | 9/1952 | Albright | ..... | 137/565.13 |
| 3,003,724 | A | 10/1961 | Kiekhaefer | | |
| 3,548,777 | A | 12/1970 | Bergstedt | | |
| 4,325,700 | A | 4/1982 | Kern | | |
| 4,493,659 | A | 1/1985 | Iwashita | | |
| 4,925,411 | A | 5/1990 | Burmeister et al. | | |
| 6,062,924 | A | 5/2000 | Nakamura | | |
| 6,106,343 | A * | 8/2000 | Nakamura | ..... | 440/61 R |
| 6,817,454 | B2 | 11/2004 | Nezu et al. | | |
| 2006/0083640 | A1 | 4/2006 | Ellens et al. | | |

* cited by examiner

*Primary Examiner*—Devon C Kramer
*Assistant Examiner*—Peter J Bertheaud
(74) *Attorney, Agent, or Firm*—Cameron IP

(57) ABSTRACT

A method for configuring a hydraulic actuator to provide energy dissipation capabilities during low energy collisions while controlling energy dissipation during high energy collisions comprises biasing a valve member towards a closed position with a resilient member having a rigidity of between 600 and 1500 lbs/in, applying a low preload to the resilient member, and restricting the flow of fluid by using a stop to limit movement of the valve member away from the closed position.

4 Claims, 3 Drawing Sheets

ENERGY DISSIPATION VALVES FOR HYDRAULIC CYLINDERS

CROSS-REFERENCE TO RELATED APPLICATION

This application is a continuation of U.S. patent application Ser. No. 10/961,372 filed on Oct. 12, 2004, now abandoned, the complete disclosure of which is incorporated herein by reference.

BACKGROUND OF THE INVENTION

This invention relates to actuators and to energy dissipation devices therefor and, in particular, to energy dissipation valves for hydraulic actuators used for tiltable marine drive units.

Linear hydraulic actuators typically include a piston reciprocatingly received within a cylinder. A piston rod is connected to the piston and extends through one end of the cylinder at least. The piston is moved by supplying pressurized hydraulic fluid to the cylinder on one side of the piston, causing the piston to move in the opposite direction. These actuators may be used for many purposes including tilt actuators and/or trim actuators for tiltable marine drive units. Tilt actuators are used to tilt outboard motors or inboard/outboard drives located at the stern of the marine craft. Tilt actuators tilt the drive units downwardly to render the drive units operational and tilt the drive units upwardly when not in use. Trim cylinders are used to adjust the angle of the drive units for proper operation of the marine craft.

Such drive units have a leg which extends downwardly with a propeller located near the bottom thereof. The leg and propeller are located below the bottom of the marine craft and are susceptible to hitting underwater objects. Damage to the drive unit, the marine craft itself or both the drive unit and the marine craft may occur as a result of such collisions. Accordingly it is conventional to permit extension of the tilt actuators and trim actuators under shock loading as occurs during collisions was underwater objects. This is conventionally achieved by providing energy dissipation valves or impact valves for tilt actuators and/or trim actuators. These valves are typically located on the piston of such an actuator and may comprise a spring-loaded valve member located on the passageway through the piston. An impact event increases pressure in the hydraulic fluid sufficiently to move the valve member against the spring and allow hydraulic fluid to flow through the passageway from one side of the piston to the other. This allows the actuator to extend as a result of an impact event. The extension of the actuator allows the drive unit to dissipate energy by tilting upwardly and minimizes damage resulting from the impact.

However the configuration and specifications of such valves had to be tightly controlled in order to provide proper energy dissipation. Simply put, if the valves only release once the pressure is at too high a level, then the drive unit would encounter too much resistance to tilting in the event that the motor contacts an object, potentially resulting in damage to the motor or boat. On the other hand, if the valve releases at too low a pressure, the motor may swing upwardly too fast, again potentially damaging the motor or boat. The valve must dissipate sufficient energy with respect to the impact and the inertia of the drive to not cause significant damage to the marine craft or drive.

One of the critical factors with some earlier energy dissipation valves is the preload on the valve spring. The preload on the valve had to be tightly controlled in order for the valve to release at an appropriate pressure level and to dissipate the correct amount of energy during an impact event. In fact, prior art valves cope with high energy situations, for example when the motor encounters an object at high speed, by increasing the preload on the spring. However the effect of increasing preload is to lose low energy capability. In other words, the valve does not sufficiently open to dissipate energy during low speed collisions.

The invention is also applicable to other applications besides marine drives where it is desirable to dissipate energy by allowing movement of hydraulic actuators during shock or impact events. However the invention should be differentiated from standard shock absorbers, used on vehicles for example, which are active at all times and respond to hydraulic pressure fluctuations. The invention by contrast is adapted only to respond to extraordinary impact events. The valve does not responded to all impact events and resulting pressure increases below a certain threshold.

SUMMARY OF THE INVENTION

According to one aspect of the invention there is provided a hydraulic actuator comprises a cylinder, a piston reciprocatingly received within the cylinder, a piston rod connected to the piston and a pressure release mechanism which allows hydraulic fluid to pass from a first side of the piston to a second side of the piston when the actuator encounters shock loading. This permits the piston to move. The pressure relief mechanism includes a passageway extending from the first side of the piston to the second side of the piston and a valve member releasably engaging the piston adjacent to the passageway. The valve member has a closed position where the valve member closes the passageway and engages the piston. A resilient member biases the valve member towards the closed position. A valve member limiter limits movement of the valve member away from the closed position. The resilient member has a rigidity sufficiently great so that movement of the valve member away from the closed position is more dependent upon the rigidity of the resilient member than upon a preload applied to the valve member.

According to another aspect of the invention, there is provided a marine craft with a stern and a tiltable drive unit at the stern, the drive unit having a hydraulic actuator connected to the craft. The hydraulic actuator comprises a cylinder, a piston reciprocatingly received within the cylinder, a piston rod connected to the piston and a pressure release mechanism which allows hydraulic fluid to pass from a first side of the piston to a second side of the piston when the drive unit encounters an obstacle. This permits the unit to tilt. The pressure relief mechanism includes a passageway extending from the first side of the piston to the second side of the piston and a valve member releasably engaging the piston adjacent to the passageway. The valve member has a closed position where the valve member closes the passageway and engages the piston. A resilient member biases the valve member towards the closed position. A valve member limiter limits movement of the valve member away from the closed position. The resilient member has a rigidity sufficiently great so that movement of the valve member away from the closed position is more dependent upon the rigidity of the resilient member than upon a preload applied to the valve member.

According to a further aspect of the invention, there is provided a method for configuring a hydraulic actuator connecting a tiltable drive unit to a marine craft to permit the drive unit to tilt when the drive unit encounters an obstacle. The actuator includes a cylinder with a piston reciprocatingly received therewithin. The method comprises providing the piston with a passageway extending from a first side thereof to a second side thereof and providing a valve member having an open position where the passageway is open and a closed position where the passageway is closed. The valve member is biased towards the closed position with a resilient member having sufficient rigidity so that movement of the valve member towards the open position, when the encounters the obstacle, is more dependent upon the rigidity of the resilient member than upon a preload applied to the valve member.

According to a still further aspect of the invention, there is provided a shock absorbing apparatus comprising a fluid actuator having a piston with a passageway therethrough and a valve controlling fluid flow from one side of the piston to another side thereof. The valve includes a closure member biased towards a valve seat by a resilient member and a stop limiting movement of the closure member away from the valve seat. The resilient member has a rigidity such that initial opening of the closure member with respect to the valve seat, due to pressure of fluid in the passageway, is determined by preload applied to the closure member by the resilient member. Movement of the closure member further away from the valve seat, until limited by said stop, is determined more by the rigidity of the resilient member than the preload. Fluid flow through the passageway is limited by an orifice between the closure member and the valve seat when the stop limits movement of the closure member away from the valve seat.

According to a still further aspect of the invention, there is provided a method of absorbing shock using a fluid actuator with a piston having a passageway therethrough and a valve controlling fluid flow from one side of the piston to another side thereof, the valve including a closure member biased towards a valve seat by a resilient member. The method comprises applying a preload to the closure member with the resilient member such that initial opening of the closure member with respect to the valve seat, due to pressure of fluid in the passageway, is determined by the preload applied to the closure member by the resilient member. Rigidity for the resilient member is selected such that movement of the closure member further away from the valve seat is determined more by the rigidity of the resilient member than the preload. Movement of the closure member away from the valve seat is limited such that fluid flow through the passageway is controlled by an orifice between the closure member and the valve seat when the movement of the closure member away from the valve seat is so limited.

BRIEF DESCRIPTIONS OF THE DRAWINGS

DETAILED DESCRIPTIONS OF THE PREFERRED EMBODIMENTS

Figure 1:
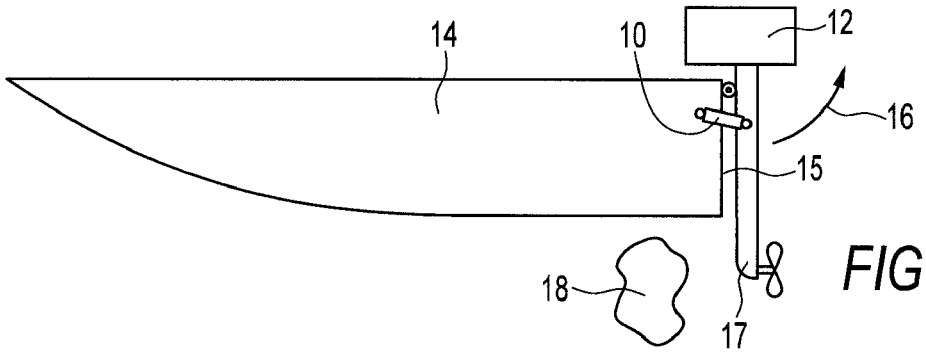
FIG. 1 is a side view of a marine craft equipped with an outboard motor fitted with an actuator according to an embodiment of the invention.

Referring to the drawings, and first FIG. 1, this shows a marine craft, in this case a boat 14 equipped with an outboard motor 12 mounted on transom 15 of the boat. The general arrangement is standard and accordingly is not described in more detail. It should also be understood that the invention is applicable for other tiltable marine drive units such as inboard/outboard drives. For example the invention is applicable to other movable members besides marine drive units which are mounted on larger bodies other than boats. If bottom 17 of the motor contacts an object, such as rock 18, damage to the motor or boat may occur. In an extreme scenario the motor could potentially be ripped from the boat.

The outboard motor or other drive unit is capable of tilting relative to the transom as indicated by arrow 16. Tilting of the motor is accomplished utilizing a tilt actuator 10 which is a generally conventional hydraulic actuator in this example. It is known in the art to provide an energy dissipation valve in the actuator to permit the motor to tilt upwardly in the event that the motor contacts an object such as the rock 18 and thereby reduce the risk of damage to the motor and boat. The invention is also applicable to actuators used for adjusting the trim of marine drives. The actuator is adjustable to a certain position, for example the tilt angle of the engine, by applying pressurized hydraulic fluid to one end of the cylinder or the other. Thereafter, subject to readjustment, the actuator is expected to remain in that position during use unless an unexpected obstacle is encountered. The actuator is not responsive to normal loading applied to the motor in a sense of a conventional shock absorber.

Figure 2:
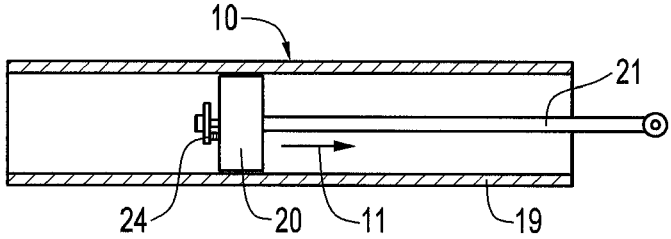
FIG. 2 is a simplified side view, partly in section, of the actuator.

Referring to FIG. 2, the tilt actuator has a piston 20 connected to a piston rod 21. The piston is reciprocatingly received in cylinder 19 of the actuator. The actuator is also equipped with an energy dissipation valve 24. The goal of the energy dissipation valve (commonly known as a blowoff valve) is to allow the piston to move rapidly in the direction indicated by arrow 11 if the drive unit contacts an underwater object, to allow the motor to tilt.

Figure 3:
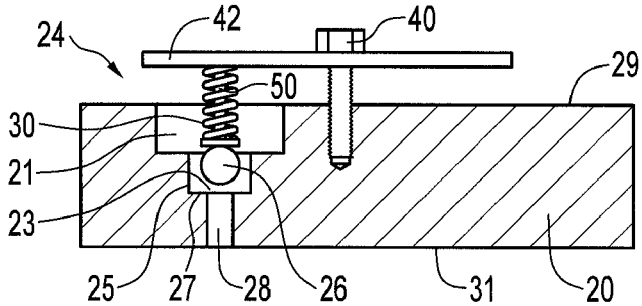
FIG. 3 is a side view, partly in section, of the piston thereof, showing an energy dissipation valve of the actuator.

Referring to FIG. 3, piston 20 has a recess 21 on side 29 thereof which communicates with a deeper and narrower recess 25 in this example. The recess 25 communicates with side 31 of the piston via passageway 28. There is an annular shoulder at the point where the passageway 28 communicates with the recess 25, forming a valve seat 27 for a valve member, ball 26 in this example, of energy dissipation valve 24. In other examples a poppet valve, a balanced poppet type valve, a flat plate and valve, a reed valve or other types of valves or valve or closure members could be used. When the valve is open, as shown in FIG. 3, there is a gap or orifice 23 between the ball 26 and the valve seat, permitting a controlled flow rate based on the drop in pressure of hydraulic fluid through the passageway 28 from side 31 of the piston to side 29 thereof.

Figure 4:
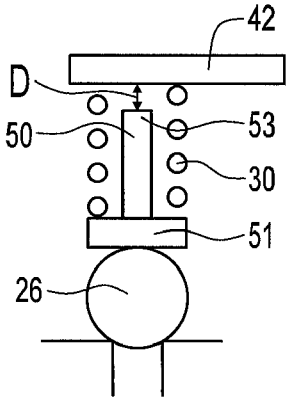
FIG. 4 is an enlarged, fragmentary, diagrammatic view of the energy dissipation valve.

The ball 26 is resiliently biased towards the valve seat 27 by a spring, coil spring 30 in this example. In other examples the coil spring could be replaced by a Belleville washer or a beam type spring or other types of springs could be used. The spring extends about a rod-like spring guide 50 which is fitted with a disk-shaped spring stop 51 shown best in FIG. 4. The spring is biased between the spring stop 51 and a second, movable spring stop 42 which is shaped like a washer in this example and is secured to the piston by a bolt 40 shown in FIG. 3. The stop and guide act together as a limiter to limit movement of the valve 24 away from the closed position. Preloading on the spring 30 can be adjusted by changing the distance the spring is compressed and accordingly the distance between the stop 42 and the valve seat 27 can be adjusted. In the normal position of the valve, when the ball 26 is seated against the valve seat 27, as shown in FIG. 4, there is a gap D between outer end 53 of the valve guide 50 and the spring stop 42. The gap in this example is 0.030", but this could vary in alternative embodiments. The gap can be readily adjusted to establish the maximum orifice size available for energy dissipation. The gap and the preload are adjusted independently.

In this embodiment of the invention, operation of the energy release valve is dictated by the following three factors:

1. The spring constant (or rigidity) of spring 30.
2. The amount of gap D.
3. The amount of preload applied to the spring 30 by spring stop 42.

Conventionally the spring constant of such springs is approximately 200-400 lbs/in. However in the present invention, springs of a much higher spring constant are employed. The spring constant of spring 30 is in the range of 600-1500 lbs/in, preferably at least 750-1000 lbs/in and more preferably approximately 875 lb/in.

Operation of the valve 24 during an energy release event occurs in the following four stages:

1. Start of Event. The initial cracking open of the valve is a function of the preloading on the spring 30. The invention permits this preloading to be set at a relatively low level so that the valve will respond to low energy events. In other words, sufficient tilting of the drive unit occurs for a low-speed collision.
2. Initial Opening. During initial opening, but after the valve has been cracked open, the valve operates in a "changing orifice" mode where valve operation is controlled by the spring constant of spring 30. In other words, the change in pressure required to move the ball 26 is dictated by the spring constant and higher pressure moves the ball further off of the valve seat 27.
3. Most of Event. During most of the energy release event, approximately 90% or more of the event, the valve operation is controlled by the gap D. The valve is fully open when the gap D is closed and the valve operates as a fixed orifice valve. The size of the orifice dictates the flow of fluid through passageway 28 and accordingly the level of energy dissipation.
4. End of Event. Near the end of the event the pressure drops and the valve begins to close. The valve again operates in a "changing orifice" mode as the valve guide moves away from stop 42 and the ball 26 approaches valve seat 27. Again the valve is effectively controlled by the spring constant during this stage of operation.

The invention, by utilizing a relatively high spring constant for spring 30, does not require high spring preloading as found in prior art valves of the type. The preload instead can be set at a low value to provide energy dissipation capabilities for low energy collisions. The high spring preloading is not required because travel of the ball 26 away from valve seat 27 is limited when gap D is closed, providing a restricted orifice 23 between the ball and the valve seat in order to control energy dissipation during high energy impacts instead of relying on high spring preloading for this function.

By using the combination of a high spring constant for spring 30 as well as controlling the maximum size of orifice when end 53 of the spring guide 50 contacts stop 42, there is a low sensitivity to the spring preload. In this example, the range of preloading is ±25% although this would vary in alternative embodiments. The invention permits the use of loose spring tolerances which expedites the usage of standard spring manufacturing tolerances and allows the preload to be set at relatively low values to provide dissipation capabilities for low energy impacts.

Figure 6:
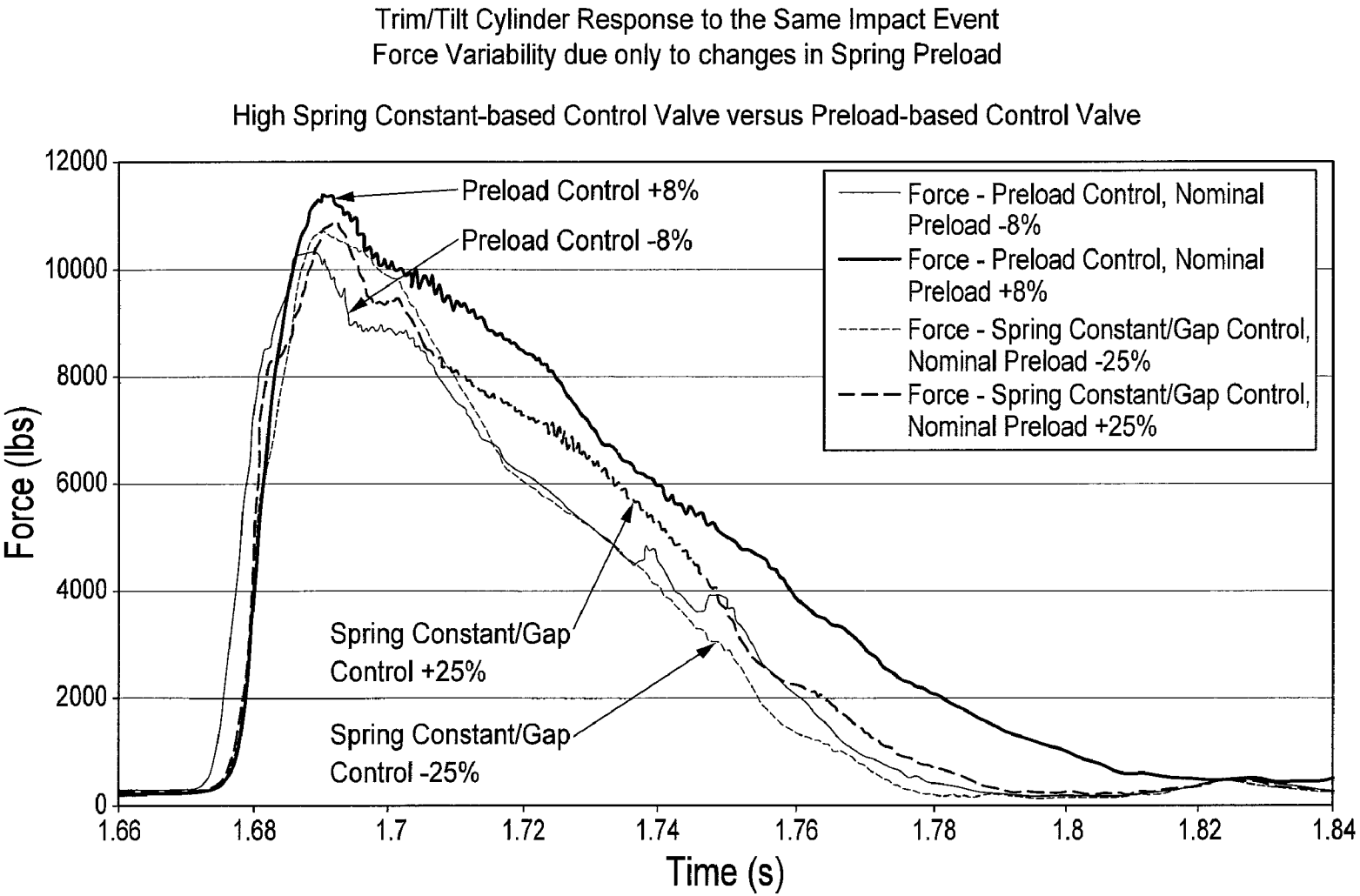
FIG. 6 is a graph showing the responses of trim/tilt cylinders to an impact event and the force variability due to changes in spring preload.
Figure 7:
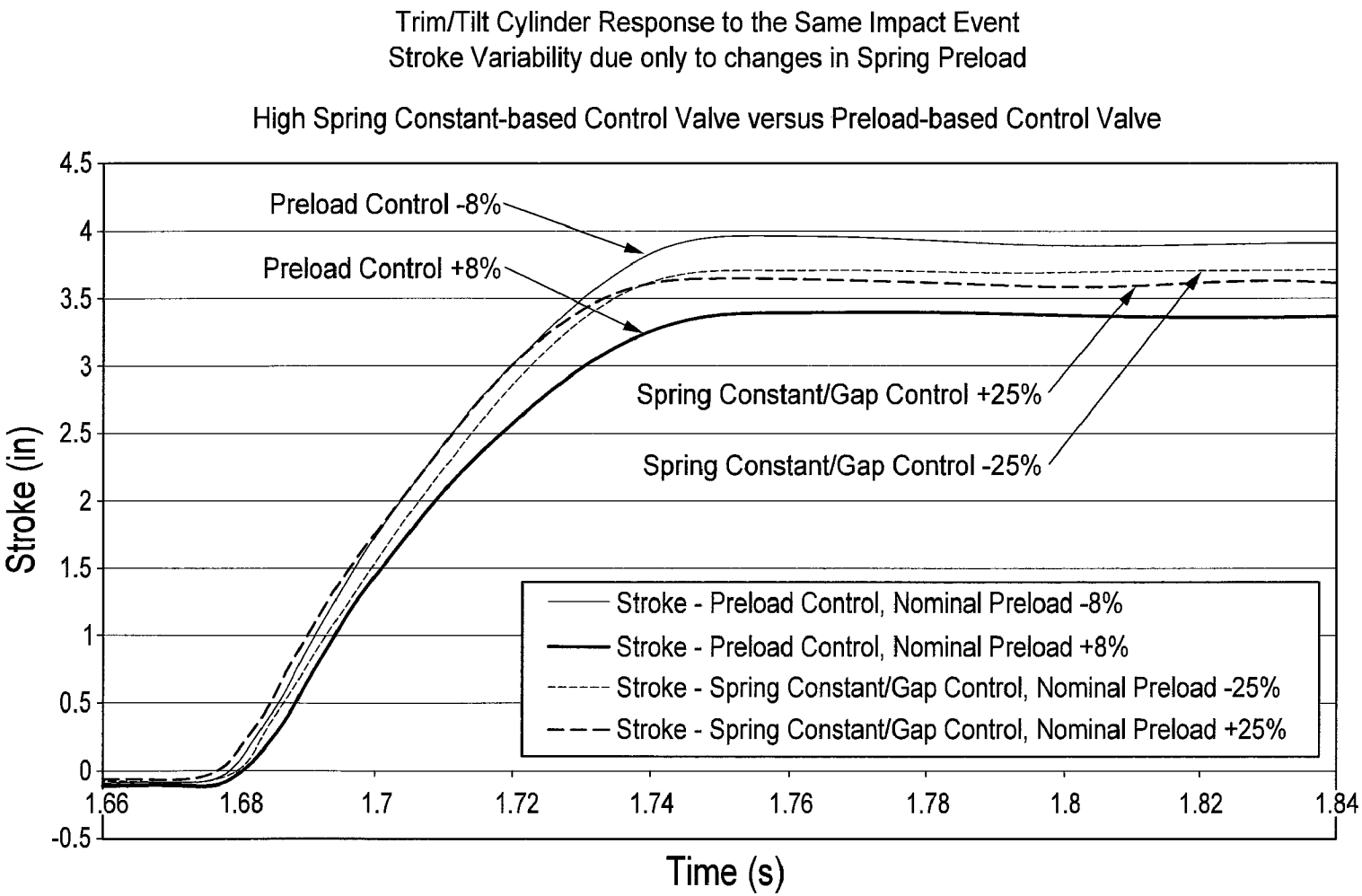
FIG. 7 is a graph showing the responses of trim/tilt cylinders to an impact event and stroke variability due to changes in spring preload.

Referring to FIGS. 6 and 7, these show the response to the same impact event for both a conventional preload-based impact valve and a high spring constant-based impact valve according to an embodiment of the invention. The same amount of energy is dissipated in each instance. Changes in cylinder shaft force and piston stroke are shown as a function of spring preload. The conventional preload-based valve shows a large variability in force and stroke with only ±8% changes in preload. By comparison, the high spring constant-based valve displays negligible variation in force and stroke with ±25% changes in preload. In this example the spring constant in the conventional preload-based valve is 225 lbs/in, whereas the spring constant according to an embodiment of the invention is 875 lbs/in.

In this example, the conventional preload-based valve employs six spring/ball valves in the piston, whereas the high spring constant-based valve according to the invention uses only four. Therefore the high spring constant-based valve requires fewer parts and looser tolerances to achieve significantly better control of impact events.

In some marine drive applications, a traditional preload-based valve requires two different spring constants set to two different preloads to achieve the same response as a high spring constant valve, according to the invention, achieves using only one spring rate and one preload setting. For two different applications, the prior art valve needed different springs while the high spring constant-based valve use the same spring in both applications.

The low sensitivity to preload variation allowed the preload of the high spring constant-based valve to be appropriately set to control both low energy and high energy events. The prior art preload-based piston required one spring with a lower spring rate set to half the preload of the remaining springs in order to control low energy impacts. The spring rates in the preload-based valve were set at 345 lbs/in and 300 lbs/in; whereas the high spring constant-based valve used a spring rate of 875 lbs/in.

Figure 5:
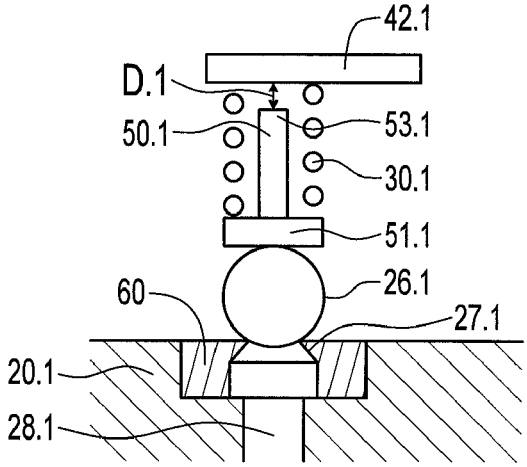
FIG. 5 is a view similar to FIG. 4, but showing a variation of the valve with a sharp edge orifice.

FIG. 5 shows a variation of the valve shown in FIG. 4 where like parts of like numbers with the additional designation "0.1". In this example piston 20.1 has an annular orifice insert 60 which is undercut adjacent to valve seat 27.1, resulting in a sharp edge orifice which reduces the effects of fluid viscosity.

Although the invention is described above as applying to tilt or trim cylinders for marine drive units, it could be applicable to other situations such as truck cab tilt systems which use hydraulic actuators. These systems conventionally have the capability for the cab to move due to the truck hitting bumps in the road when the cab tilt actuator is in a locked position. This free motion can be accomplished using a valve similar to that described above. In existing units this is accomplished by having a section of the actuator constructed so that fluid passageways exists between the two sides of the piston when the actuator is in the "down" and locked position. Using a valve as described above, would be more desirable and possibly less costly. It would also provide for the ability to have the unit act as a shock absorber or energy absorber during the motion caused by a reaction from the truck hitting a bump in the road.

It would be understood by someone skilled in the art that many of the details provided above are by way of example only and are not intended to limit the scope of the invention which is to be interpreted with reference to the following claims.

What is claimed is:

1. A method for configuring a hydraulic actuator used for a tiltable marine drive unit to provide energy dissipation capabilities during low energy collisions while controlling energy dissipation during high energy collisions, the hydraulic actuator including a cylinder with a piston reciprocatingly received therein, the method comprising:

providing the piston with a passageway extending from a first side thereof to a second side thereof, the passageway allowing for the flow of fluid from a first side of the cylinder to a second side of the cylinder;

providing a valve member on the piston to restrict the flow of fluid from the first side of the cylinder to the second side of the cylinder, the valve member having an open position in which fluid flows through the passageway from the first side of the cylinder to the second side of the cylinder, and the valve member having a closed position in which fluid does not flow through the passageway from the first side of the cylinder to the second side of the cylinder;

biasing the valve member towards the closed position with a resilient member having a rigidity of between 600 and 1500 lbs/in;

applying a preload to the resilient member which is sufficiently low so that the valve member opens during low energy collisions; wherein the initial cracking open of the valve is primarily dependent on the preload, not the rigidity of the resilient member; and after the valve cracks open movement of the valve member towards the open position and back towards the closed position is primarily dependent on the rigidity of the resilient member, not on the preload applied to the valve member; and restricting the flow of fluid from the first side of the cylinder to the second cylinder when the valve member is in the open position by using a stop to limit movement of the valve member away from the closed position, thereby controlling the flow of fluid though the passageway and the level energy dissipation.

2. The method as claimed in claim 1, wherein the resilient member has a rigidity of between 750 and 1000 lbs/in.

3. The method as claimed in claim 1, wherein the resilient member has a rigidity of 875 lbs/in.

4. The method as claimed in claim 1, wherein movement of the valve member away from the closed position is limited to between 0.025 and 0.035 of an inch.

* * * * *